US009309854B2

(12) United States Patent
Provost

(10) Patent No.: US 9,309,854 B2
(45) Date of Patent: Apr. 12, 2016

(54) BATTERYLESS ENGINE STARTING SYSTEM

(76) Inventor: Brian Provost, Loreauville, LA (US)

( * ) Notice: Subject to any disclaimer, the term of this patent is extended or adjusted under 35 U.S.C. 154(b) by 878 days.

(21) Appl. No.: 13/527,734

(22) Filed: Jun. 20, 2012

(65) Prior Publication Data

US 2013/0340698 A1 Dec. 26, 2013

(51) Int. Cl.
*F02N 3/00* (2006.01)
*F02N 3/02* (2006.01)
*F02N 11/08* (2006.01)

(52) U.S. Cl.
CPC ..... *F02N 3/02* (2013.01); *F02N 11/0862* (2013.01); *F02N 2011/0885* (2013.01)

(58) Field of Classification Search
CPC F02N 3/02; F02N 11/0862; F02N 2011/0885
USPC ..... 123/65 R, 69 R, 73 C, 73 DA, 179.1, 123/179.5, 179.7, 179.11, 179.22, 179.24, 123/185.7, 179.28, 185.2; 74/6–9
See application file for complete search history.

(56) References Cited

U.S. PATENT DOCUMENTS 4,674,462 A * 6/1987 Koch ..... F02M 69/08 123/531
4,893,594 A * 1/1990 Kobayashi ..... F02M 1/16 123/179.11
5,161,496 A * 11/1992 Matsushima ..... F02D 41/062 123/149 D
5,201,288 A * 4/1993 Doragrip ..... F02M 69/10 123/73 A
6,526,938 B1 3/2003 Bylsma et al.
6,914,342 B1 7/2005 French
7,066,162 B1 6/2006 Ng
7,789,074 B2 9/2010 Tashima

FOREIGN PATENT DOCUMENTS

JP 2005/330815 A 12/2005
JP 2005330815 A * 12/2005

* cited by examiner

*Primary Examiner* — Mahmoud Gimie
*Assistant Examiner* — David Hamaoui
(74) *Attorney, Agent, or Firm* — Keaty Law Firm, LLC

(57) ABSTRACT

A system for starting an internal combustion engine without assistance of a battery uses a pull-start assembly to generate electricity and store the generated power in one or more capacitors electrically connected to an electronic control unit via a permanent magnet alternator. The system includes a hand pump for manually forcing a portion of liquid fuel into an air/fuel mixture chamber while an air relief valve connected to an air injector is open. By closing the relief valve and activating the pull-start assembly, the user causes the fuel into the combustion chamber, where the ignition process is initiated upon receipt of a control signal from the electronic control unit.

32 Claims, 1 Drawing Sheet

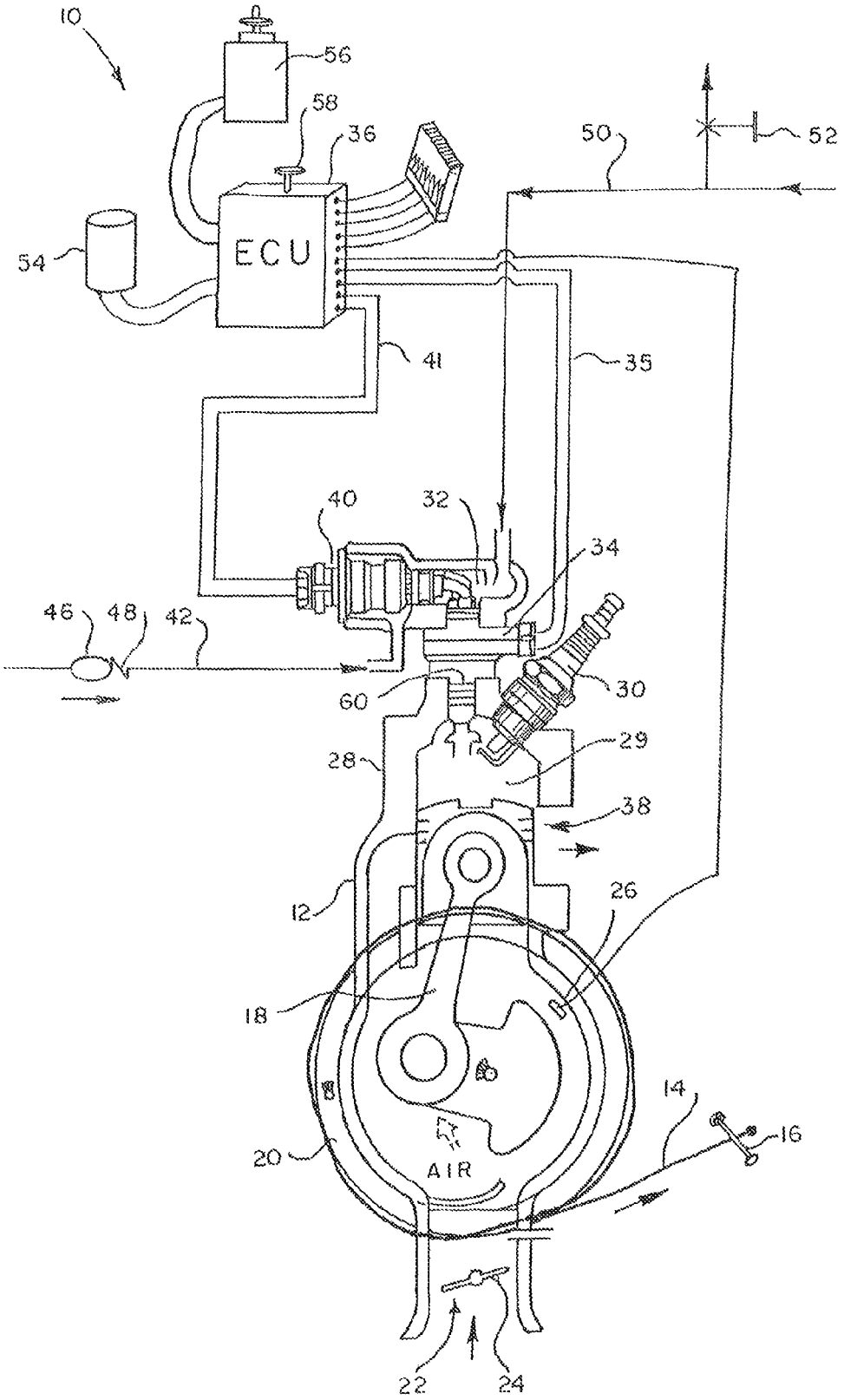
10
56
58
36
50
52
ECU
54
41
35
40
32
34
46
48
42
60
30
29
28
38
12
26
18
14
16
20
AIR
22
24

BATTERYLESS ENGINE STARTING SYSTEM

BACKGROUND OF THE INVENTION

This invention relates to gasoline engines and more particularly, to an engine starting system for internal combustion engines.

Conventional boat engines are typically provided with either a pull-start system or a starter motor. In the pull-start system, the user starts the engine by pulling on a rope coupled to a crankshaft. The starter motor is typically connected to an on-board battery, which initiates rotation of the crankshaft and starting of the engine. Batteries are typically large; they occupy valuable space on the boat. With pull-start systems no batteries are required.

It is well known that two-stroke engines are more powerful that four stroke engines of equivalent size. Two-stroke engines fire once every revolution, while four-stroke engines fire once every other revolution. This gives two-stroke engines a significant power boost. Such engines are lighter and simpler in construction. Small power tools, outboard motors, jet skis, light motorcycles and the like have all employed two-stroke engines. Unfortunately, most two stroke engines are inefficient and are highly pollutant due to the amount of unspent fuel that escapes through the exhaust port.

The industry has developed a two-stroke low pressure direct injection system (TLDI) such as for instance Nissan/Tohatsu injection system. This system was designed to make two stroke outboard motors meet emissions regulations while running on gasoline. The preferred fuel source for Nissan/Tohatsu motor is gasoline although it appears to be capable of running on heavy fuels, such as diesel.

In the context of watercraft, heavy fuel is preferred since it reduces the risk of fire and significantly reduces the amount of harmful exhaust. However, starting a two-stroke motor on heavy fuel is a problem. Sometimes conventional engines will start on kerosene or jet fuel JP-5 using the electric starter but not easily. With a pull rope starter it is not possible. Furthermore, the conventional Nissan/Tohatsu engine with the two-stroke system will not run without a battery. The orbital system uses one fuel injector, one air injector, and one ignition coil per cylinder, and one high pressure fuel pump. Each of these components operates using electricity. This system needs a large electrical supply compared to other known outboard motors. In fact, Nissan recommends a battery with 850 to 1000 cranking amps.

Thus, there is a need for a marine engine having a starter system that alleviates the need for a battery and that can operate on heavy fuel. The present invention contemplates elimination of the drawbacks of prior starter systems for marine engines and provision of a batteryless heavy fuel starting system.

SUMMARY OF THE INVENTION

It is, therefore, an object of the present invention to provide an improved engine starting system that operates without a battery.

It is another object of the invention to provide a pull-start system for marine engines that operate on heavy fuel.

These and other objects of the invention are achieved through a provision of a system for starting an internal combustion engine without assistance of a battery. The engine can be a two-stroke or a four-stroke engine powered by heavy fuel or light fuel. The system uses a pull-start assembly to generate electricity and store the generated power in one or more capacitors electrically connected to an electronic control unit via a permanent magnet alternator. The system includes a hand pump for manually forcing a portion of liquid fuel into an air/fuel mixture chamber while an air relief valve connected to an air injector is open. By closing the relief valve and activating the pull-start assembly, the user causes the fuel into the combustion chamber, where the ignition process is initiated upon receipt of a control signal from the electronic control unit.

BRIEF DESCRIPTION OF THE DRAWINGS

Reference will now be made to the drawings, wherein like parts are designated by like numerals, and wherein FIG. 1 is a schematic view of the engine starting system according to this invention.

DETAIL DESCRIPTION OF THE INVENTION

Turning now to the drawings in more detail, numeral 10 designates the starting system according to this invention. The system 10 comprises a propulsion unit with an engine 12, which is a two-stroke internal combustion engine, which can operate on heavy fuel and light fuel. For convenience of illustration, the engine 12 is oriented upright although it is envisioned that other orientations of the engine 12 are within the scope of this invention.

The engine 12 uses a pull-start assembly, where the starter utilizes a rope 14 with a grip handle 16 at the end, coiled around an end of a crankshaft and flywheel assembly 18. The crankshaft and the flywheel assembly 18 are mounted inside a crankcase 20. When the rope's grip 16 is pulled, the rope 14 uncoils spinning it to crank the engine 12. An air intake conduit 22 is formed in the crankcase 20. An air intake valve 24 is mounted in the air intake conduit 22. A stoke sensor 26 is coupled to the crankshaft/flywheel assembly 18 and an electronic control unit 36.

The crankshaft housing 20 is coupled to a piston housing 28. The piston housing carries a spark plug 30 extending into a combustion chamber 29; the piston housing is provided with air/fuel mixture chamber 32 mounted in fluid communication with the combustion chamber 29. An air injector is fluidly connected to the air/fuel mixture chamber. The air injector 34 is used to inject a fine mist of fuel and compressed air into each combustion chamber. An electronic control system (ECU) 36 determines the mixture and timing for injecting fuel according to current engine operating conditions base on information relayed to the ECU 36 from various sensors. The air injector 34 is operationally connected to the ECU 36 via wiring 35. An exhaust conduit 38 is formed in the piston housing 28 for exhausting spent gas from the internal combustion engine.

A fuel injector assembly 40 is mounted in fluid communication with the air/fuel mixture chamber 32 and operationally to the control unit, ECU 36 via wiring 41. The fuel injector supplies the liquid fuel, which can be heavy fuel, via a fuel supply line 42 to the engine 12. A manual pump 46 with a check valve 48 is mounted in the fuel supply line 42. A compressed air supply line 50 is fluidly connected to the piston case 28 for supplying compressed air to the air/fuel mixture chamber 32. A relief valve 52 is mounted in the compressed air supply line 50.

The ECU 36 receives and processes signals from a number of sensors in addition to the stroke sensor 26. Although not shown in detail it will be understood that the ECU is operationally connected to a throttle position sensor, crank position sensor, water temperature sensor, oil level sensor, and air and fuel injectors. Additionally, the ECU 36 is operationally connected to one or more specific-energy storage devices such as capacitors 54, the function of which will be described in more detail hereinafter.

An auxiliary power device 56 is operationally connected to the ECU 36 and the pull-start assembly. In the preferred embodiment, the auxiliary power device is a permanent magnet alternator (magneto) 56, which creates a magnetic field and supplies electrical charge during the pull start process. The compact permanent magnet alternator 56 converts mechanical energy of the rotating crankshaft to electrical energy needed for starting operation of the ECU 36. The alternator 56 is in electrical communication with the ECU, which controls opening and closing of the valves of the system 10 and the engine 12. The ECU 36 is further provided with a reset button 58, which is a two-position button, moving up and down.

The system of the present invention is capable of starting the engine 12 without the aid of an electric starter and without a battery. To start the engine 12 the combustion chamber 29 must be filled with fuel vapor of the heavy fuel. To accomplish this start, the ECU fuel injector 40 and the air injector 34 programming differs from the conventional systems.

On a stock engine the air injectors 34 normally open and close with every compression stroke of the engine whether the engine is being started or is running. At priming, the modified heavy fuel starting system 10 holds the air injectors 34 closed during the complete pull of the rope starter 14, keeping extra prime fuel from entering the combustion chamber, and holding cylinder pressure from backing up into the air/fuel mixture chamber 32. The fuel injectors normally open and close with every compression stroke of the engine whether the engine is being started or is running. At priming the modified heavy fuel starting system holds the fuel injectors open during the complete pull of the rope starter, injecting more of the pressurized fuel, supplied by a hand primer bulb, into the air/fuel mixture chamber 32.

With the reset button 58 in the down position, ECU is programmed to allow the electrical energy generated by the pull of the rope 14 to keep the fuel injector valve 40 open for two or three pulls. Each pull of the rope 14 equals two strokes of the engine 12. Pulling of the rope 14 turns the alternator 56 and creates the necessary electric power for storing in an energy storage device, such as capacitor(s) and powering the start-up of the system 10.

The pressurized fuel is supplied by the user pumping the hand pump 46 and forcing the fuel through the fuel line 42. During preliminary tests it was determined that a pressure of about 20 psi was sufficient for the supply line 42 during the starting process.

At the same time, the air supply to the air/fuel mixture chamber 32 has to be diverted to eliminate pressure in the area where the fuel is injected so to allow the fuel pressure not to be overcome, eliminating fuel from entering through the fuel injector and moving to the air injector and finally into the combustion chamber 29. This diversion is accomplished by hand operating the relief valve 52, which can be installed on the air rail. The air relief valve 52 relieves all air pressure supplied by the air compressor.

An orifice 60, through which air and fuel mix and approach the air injectors is altered to keep prime fuel in the air/fuel mixing chamber 32 from draining away from the air injectors 29 till the second step occurs in the starting process. The capacitors 54 store enough charge to hold the fuel valve 48 open and allow fuel to go into the air/fuel mixture chamber 32. The compressed air valve (relief valve 52) remains open to atmosphere until fuel is pumped into the air/fuel mixture chamber 32.

The second step in the starting process is to close the relief valve 52 thereby causing air supply from air compressor to flow directly into air/fuel mixing chamber 32. After priming, the air relief valve 52 is closed and the pull rope starter 14 is pulled again. This operates the air compressor and builds pressure in the air/fuel mixture chamber 32. The air injectors 34 are still being held closed by the ECU. Fuel and air are now at the air injectors 34 with pressure ready to be allowed into the combustion chamber 29 by the air injectors. The fuel injector valve is closed at this stage by the ECU to prevent higher pressure air/fuel mixture from backing up into fuel supply.

After two pulls of the rope 14 with the reset button in the upward position, as sensed by the stroke sensor 26, the air injector 34 is opened during the following pull of the rope 14, thereby injecting a fine vapor of fuel and air into each combustion chamber 29. The ECU 36 begins to function in its normal capacity determining mixture and timing for injecting fuel into a running engine, operating on conditions and information related to ECU by various sensors. If the engine 12 does not start, the starting procedure is repeated, by pressing the reset button 58 on the ECU 36 and repeating the above steps of pressurizing the fuel line, opening the relief valve, pulling the rope, then closing the relief valve to build pressure and pulling the rope again. On the following pull, start up of the engine and normal running of engine occurs.

In summary, the engine starting procedure is simplified and improved: during the starting procedure, the priming step directs the user to pump fuel using the hand pump 46 into the chamber 32, open the relief valve 52 and pull the rope 14 two or three times. The generated energy is transmitted from the alternator 56 to the capacitors 54 to store the created energy. The user then closes the relief valve 52 and pulls the rope 14 two times. By that time, the air/fuel mixture has been delivered into the chamber 32. The user then pulls the rope 14 again, and the engine starts on the first or second pull when the spark plug 30 ignites the fuel/air mixture in the combustion chamber 29.

The 12-volt charging system 10 is wired to the capacitors 54. When the crankshaft 18 is rotated the system charges the capacitors 54. These capacitors regulate and hold the charge long enough for the fuel injectors, air injectors, and ignition coils to work. The capacitors 54 also hold the charge between waves in the charge system. This capacitor system successfully replaces a battery while the engine is starting.

It is envisioned that a kit for modifying conventional systems, such as for instance the Nissan/Tohatsu engine can be provided according to the teachings of the instant invention. The kit will eliminate the need for a battery to start the motor. It is also envisioned that the system of the present invention can be used for starting a four-stroke internal combustion engine without assistance of a battery.

Many changes and modifications can be made in the design of the present invention without departing from the spirit thereof. I, therefore, pray that my rights to the present invention be limited only by the scope of the appended claims.

I claim:

1. A system for starting an internal combustion engine without assistance of a battery, the engine including an air injector, a fuel injector, an air/fuel mixture chamber and a combustion chamber, the system comprising:

a pull-start assembly coupled to the engine;

a means operationally connected to the pull-start assembly for converting mechanical energy created by the pull-start assembly into electrical energy;

at least one specific-power energy storage device electrically connected to the means for converting mechanical energy;

an electronic control unit disposed to control operation of the engine and electrically connected to the at least one specific-power energy storage device;

an air relief valve coupled to the air injector; and a manual pump coupled to the fuel injector and disposed to force at least a small portion of liquid fuel into the air/fuel mixture chamber while the relief valve is open, and wherein closing of the relief valve combined with operation of the pull-start assembly generates a signal transmitted to the electronic control unit to initiate an ignition cycle in the combustion chamber without assistance of a battery.

2. The system of claim 1, wherein the engine is disposed to operate on heavy fuel.

3. The system of claim 1, wherein the engine is disposed to operate on light fuel.

4. The system of claim 1, said means for converting mechanical energy comprises a permanent magnet alternator.

5. The system of claim 1, said at least one specific-power energy storage device comprises at least one capacitor.

6. The system of claim 1, comprising a stroke sensor mounted between the engine and the electric control unit, the stroke sensor disposed to transmit a signal indicative of operation of the pull-start assembly to the electronic control unit.

7. The system of claim 1, said electronic control unit being provided with a reset button disposed to move between a first position allowing the air relief valve to remain open and a second position causing the electronic control unit to close the air relief valve.

8. The system of claim 1, wherein the engine is a two-stroke engine and each pull of the pull-start assembly operates as two strokes of the engine.

9. The system of claim 1, the engine comprising a crankshaft and a flywheel operatively connected to the crankshaft, and the pull-start assembly comprises a rope having a first end carrying a handle and a second end operatively connected to the flywheel, and wherein the pull start assembly is disposed to initiate rotation of the crankshaft upon operating the flywheel by pulling the rope with the handle.

10. A system for starting an internal combustion engine without assistance of a battery, the engine including a crankshaft, a flywheel operatively connected to the crankshaft, an air injector, a fuel injector, an air/fuel mixture chamber and a combustion chamber, the system comprising:

a pull-start assembly coupled to the engine;

a permanent magnet alternative operationally connected to the pull-start assembly and disposed to convert mechanical energy created by the pull-start assembly into electrical energy;

an electronic control unit disposed to control operation of the engine;

at least one capacitor electrically connected to the alternator and the electronic control unit, the at least one capacitor disposed to power the electronic control unit;

an air relief valve coupled to the air injector; and a manual pump coupled to the fuel injector and disposed to force at least a small portion of liquid fuel into the air/fuel mixture chamber while the relief valve is open, and wherein closing of the relief valve combined with operation of the pull-start assembly generates a signal transmitted to the electronic control unit to initiate an ignition cycle in the combustion chamber without assistance of a battery.

11. The system of claim 10, wherein the engine is a two-stroke engine disposed to operate on heavy fuel.

12. The system of claim 10, wherein the engine is a two-stroke engine disposed to operate on light fuel.

13. The system of claim 10, comprising a stroke sensor mounted between the engine and the electronic control unit, the stroke sensor disposed to transmit a signal indicative of operation of the pull-start assembly to the electronic control unit.

14. The system of claim 10, said electronic control unit being provided with a reset button disposed to move between a first position allowing the air relief valve to remain open and a second position causing the electronic control unit to close the air relief valve.

15. The system of claim 10, wherein the engine is a two-stroke engine and each pull of the pull-start assembly operates as two strokes of the engine.

16. The system of claim 10, the pull-start assembly comprises a rope having a first end carrying a handle and a second end operatively connected to the flywheel, and wherein the pull start assembly is disposed to initiate rotation of the crankshaft upon operating the flywheel by pulling the rope with the handle.

17. A method of starting an internal combustion engine without assistance of a battery, the engine including an air injector, a fuel injector, an air/fuel mixture chamber and an internal combustion chamber, the method comprising the steps:

providing a pull-start assembly in operational connection with the engine;

providing a means operationally connected to the pull-start assembly for converting mechanical energy created by the pull-start assembly into electrical energy;

providing at least one specific-power energy storage device electrically connected to the means for converting mechanical energy;

providing an electronic control unit disposed to control operation of the engine and electrically connected to the at least one specific-power energy storage device;

providing an air relief valve coupled to the air injector;

providing a manual pump coupled to the fuel injector;

opening the air relief valve to atmosphere;

activating the pull-start assembly thereby generating mechanical energy;

converting the mechanical energy into electrical energy by the means for converting mechanical energy;

storing generated electrical energy in the at least one specific-power energy storage device;

operating the manual pump to admit at least a portion of the liquid fuel into the airlfuel mixture chamber;

closing the relief valve;

repeating activation of the pull-start assembly while activating the electronic control unit using the electric energy stored in the at least one specific-power energy storage device; and generating a signal by the electronic control unit to initiate an ignition cycle in the combustion chamber thereby starting the engine without assistance of a battery.

18. The method of claim 17, wherein the engine is disposed to operate on heavy fuel.

19. The method of claim 17, wherein the engine is disposed to operate on light fuel.

20. The method of claim 17, said means for converting mechanical energy comprises a permanent magnet alternator disposed to transmit electrical energy to the at least one specific power storage device.

21. The method of claim 17, said at least one specific-power energy storage device comprises at least one capacitor.

22. The method of claim 17, comprising a step of providing a stroke sensor mounted between the engine and the electronic control unit, the stroke sensor disposed to transmit a signal indicative of operation of the pull-start assembly to the electronic control unit.

23. The method of claim 17, comprising a step of providing a reset button coupled to said electronic control unit, said reset button being disposed to move between a first position allowing the air relief valve to remain open and a second position causing the electronic control unit to close the air relief valve.

24. The method of claim 17, wherein the engine is a two-stroke engine, and wherein each pull of the pull-start assembly operates as two strokes of the engine.

25. The method of claim 17, the pull-start assembly comprises a rope having a first end carrying a handle and a second end operatively connected to the flywheel, and wherein the pull start assembly is disposed to initiate rotation of the crankshaft upon operating the flywheel by pulling the rope with the handle.

26. A method of starting an internal combustion engine without assistance of a battery, the engine including a crankshaft, a flywheel operatively connected to the crankshaft, an air injector, a fuel injector, an air/fuel mixture chamber and an internal combustion chamber, the method comprising the steps:

providing a pull-start assembly in operational connection with the engine;

providing a permanent magnet alternator operationally connected to the pull-start assembly and capable of converting mechanical energy created by the pull-start assembly into electrical energy;

providing at least one energy storage capacitor electrically connected to the alternator;

providing an electronic control unit disposed to control operation of the engine and electrically connected to the at least one energy storage capacitor;

providing an air relief valve coupled to the air injector;

providing a manual pump coupled to the fuel injector;

opening the air relief valve to atmosphere;

activating the pull-start assembly thereby generating mechanical energy;

converting the mechanical energy into electrical energy by the alternator;

storing generated electrical energy in the at least one energy storage capacitor;

operating the manual pump to admit at least a portion of liquid fuel into the air/fuel mixture chamber;

closing the relief valve;

repeating activation of the pull-start assembly while activating the electronic control unit using the electric energy stored in the energy storage capacitor; and generating a signal by the electronic control unit to initiate an ignition cycle in the combustion chamber thereby starting the engine without assistance of a battery.

27. The method of claim 26, wherein the engine is disposed to operate on heavy fuel.

28. The method of claim 26, wherein the engine is disposed to operate on light fuel.

29. The method of claim 26, comprising a step of providing a stroke sensor mounted between the engine and the electronic control unit, the stroke sensor disposed to transmit a signal indicative of operation of the pull-start assembly to the electronic control unit.

30. The method of claim 26, comprising a step of providing a reset button coupled to said electronic control unit, said reset button being disposed to move between a first position allowing the air relief valve to remain open and a second position causing the electronic control unit to close the air relief valve.

31. The method of claim 26, wherein the engine is a two-stroke engine, and wherein each pull of the pull-start assembly operates as two strokes of the engine.

32. The method of claim 26, the pull-start assembly comprises a rope having a first end carrying a handle and a second end operatively connected to the flywheel, and wherein the pull start assembly is disposed to initiate rotation of the crankshaft upon operating the flywheel by pulling the rope with the handle.

* * * * *